US005516106A

United States Patent [19]

Henwood

[11] Patent Number: 5,516,106

[45] **Date of Patent: *May 14, 1996**

[54] GOLF CLUB HEAD

[75] Inventor: William D. Henwood, Norcross, Ga.

[73] Assignee: Nicklaus Golf Equipment Co., L.C., West Palm Beach, Fla.

[ * ] Notice: The term of this patent shall not extend beyond the expiration date of Pat. No. 5,467,988.

[21] Appl. No.: 354,657

[22] Filed: Dec. 13, 1994

Related U.S. Application Data

[63] Continuation-in-part of Ser. No. 152,439, Nov. 12, 1992, Pat. No. 5,467,988, which is a continuation of Ser. No. 20,065, Feb. 19, 1993, which is a continuation of Ser. No. 779,351, Oct. 18, 1991, abandoned.

[51] Int. Cl.[6] ..... A63B 53/04

[52] U.S. Cl. ..... 473/350

[58] Field of Search ..... 273/167 R, 167 A, 273/167 F, 169–172, 167 E, 164.1, 193 R, 194 R, 77 R, 187.4, 174, 167 H; D21/214–220

[56] References Cited

U.S. PATENT DOCUMENTS

| | | |
|---|---|---|
| D. 318,087 | 7/1991 | Helmstetter . |
| D. 321,920 | 11/1991 | Parente et al. . |
| D. 322,651 | 12/1991 | Parente et al. . |
| 1,541,126 | 6/1925 | Dunn . |
| 1,913,821 | 6/1993 | Stumpf . |
| 2,041,676 | 5/1934 | Gallagher . |
| 2,756,055 | 7/1956 | Bittner . |
| 2,954,231 | 9/1960 | MacIntyre . |
| 3,068,011 | 12/1962 | Sano . |
| 3,810,631 | 5/1974 | Braly . |
| 3,841,639 | 10/1974 | Werner . |
| 3,955,819 | 5/1976 | Yokich . |
| 3,997,170 | 12/1976 | Goldberg . |
| 4,065,133 | 12/1977 | Gordos . |
| 4,838,555 | 6/1989 | Kobayashi . |
| 4,850,593 | 7/1989 | Nelson . |
| 5,060,949 | 10/1991 | Brill . |
| 5,067,715 | 11/1991 | Schmidt et al. . |
| 5,163,682 | 11/1992 | Schmidt et al. . |
| 5,257,786 | 11/1993 | Gorman . |

FOREIGN PATENT DOCUMENTS

| | | |
|---|---|---|
| 150528 | 10/1950 | Australia . |
| 153475 | 10/1953 | Australia . |
| 644772 | 7/1962 | Canada . |
| 754431 | 3/1967 | Canada . |
| 006733 | 1/1980 | European Pat. Off. . |
| 244925 | 12/1925 | United Kingdom . |
| 340579 | 1/1931 | United Kingdom . |

OTHER PUBLICATIONS

"Can Metal Woods Help Your Game?"; *Golf Digest Magazine;* pp. 57–59; Dec., 1981.

*Golf Digest Magazine;* p. 34; Aug., 1979.

Tommy Armour Golf Advertisement; ©1991 Tommy Armour Golf, Morton Grove, Illinois.

*Primary Examiner*—Sebastiano Passaniti
*Attorney, Agent, or Firm*—Fay, Sharpe, Beall, Fagan, Minnich & McKee

[57] ABSTRACT

A golf club head having improved weight distribution comprising an integral hollow metal body with a bottom wall including a cavity recessed inwardly of the body throughout an extended area which lies rearwardly of the front striking face and inwardly of the heel and toe such that the ground engaging sole area of the head comprises a front rail portion adjacent the front striking face and side rail portions joined to the front rail portion and extending toward the rear wall. The side rail portions disposed between the center of percussion and the heel and toe areas. The recessed cavity has a size and depth sufficient to result in a concentration of club head weight in the area surrounding the center of percussion and to produce an elevation in the center of gravity of the head relative to the ground engaging sole area.

17 Claims, 5 Drawing Sheets

GOLF CLUB HEAD

This application is a continuation-in-part of U.S. Ser. No. 08/152,439 filed Nov. 12, 1993, now U.S. Pat. No. 5,467,988, which is a continuation of U.S. Ser. No. 08/020,065 filed Feb. 19, 1993, which in turn is a continuation of U.S. Ser. No. 07/779,351 filed Oct. 18, 1991, now abandoned.

BACKGROUND OF THE INVENTION

The subject invention is directed to an improved golf club head construction.

The invention is especially suited for incorporation in a cast metal golf head and will be described with particular reference thereto; however, heads embodying the invention could be formed using many known techniques.

Currently, many golf club heads of the "wood" category are manufactured from metal using investment casting techniques. These club heads are generally hollow shells with perimeter weighting. That is, the weight of the head is concentrated in the outer peripheral shell surface.

Although perimeter weighting has resulted in improvement in club performance as compared to earlier solid body club designs, it is believed that even further performance improvements can result from more desirable club head weight distribution.

SUMMARY OF THE INVENTION

The subject invention provides a metal golf club head which can produce increased effectiveness and accuracy because of its unique weight distribution. In the subject invention, the design is such that weight is removed from the center sole area and redistributed to concentrations in the heel and toe area. In a preferred embodiment, the removed weight is positioned between the heel and toe areas and the center of percussion respectively. In addition, the design raises the center of gravity of the club head which is believed to create more roll on the ball after impact with the ground and, consequently, more total ball distance results.

In accordance with the subject invention, a golf club head of the general form under consideration comprises an integral hollow metal body with a front striking face, an upper wall, a rear wall, a heel, a toe, a bottom wall forming a sole, and a hosel extending upwardly at a predetermined angle from the heel of the body for attaching the head to a shaft. An improved weight distribution results from a recessed cavity formed inwardly of the body throughout an extended area rearwardly of the front striking face and inwardly between the heel and toe such that the ground engaging sole area of the head comprises a front rail portion adjacent the front striking face and side rail portions joined to the front rail portion. The side rail portions extend toward the rear wall adjacent the heel and toe. Alternatively, the side rail portions are disposed behind the front striking face region adjacent the center of the club head, i.e. the preferred ball impact zone, and inward of the extreme heel and toe areas. This increases weight in the area surrounding the ball impact zone (center of percussion) helping off-center hits. Preferably, the side rails are sufficiently massive to result in added club head weight between the center of percussion and the heel and toe areas increasing the "sweet spot". In either embodiment, the side rails also help form a recessed cavity having a size and depth to produce an elevation in the center of gravity of the head relative to the ground engaging sole area.

Preferably, and in accordance with a more limited aspect of the invention, the side rail portions extend generally perpendicular to the front striking face and define with the front rail portion a ground engaging section generally U-shaped in plan view.

In accordance with a more limited aspect of the invention, the recessed portion is located centrally of the bottom wall and is generally aligned with the center of the front striking face. Additionally, rail portions preferably have a width in plan view not substantially greater than one-half inch and the recessed cavity has a depth of at least one-eighth and preferably at least one-quarter inch. By properly arranging and designing the recessed cavity, a significant improvement in the weight distribution and a resulting improvement in club effectiveness results. Additionally, the balance of the club head can be significantly improved.

As can be seen from the foregoing, a primary object of the invention is the provision of a club head wherein the weight of the club is moved toward the heel and toe areas and the center of gravity of the head is in an elevated position on an axis extending through the middle of the sole and in alignment with the striking face of the club.

A still further object of the invention is the provision of a club head of the type described which can be formed by conventional investment casting techniques from any of a variety of suitable metals.

A still further object of the invention is the provision of a club head of the general type described wherein an improved club head balance results from the use of a recessed sole and peripheral rail members between the center of percussion and the heel and toe areas with the peripheral rail members joined integrally with a rail extending parallel to and adjacent the striking face to provide increased club head mass immediately adjacent the center of percussion.

BRIEF DESCRIPTION OF THE DRAWINGS

The above and other objects and advantages will become apparent from the following description when read in conjunction with the accompanying drawings wherein.

DETAILED DESCRIPTION OF THE PREFERRED EMBODIMENT

Figure 2:
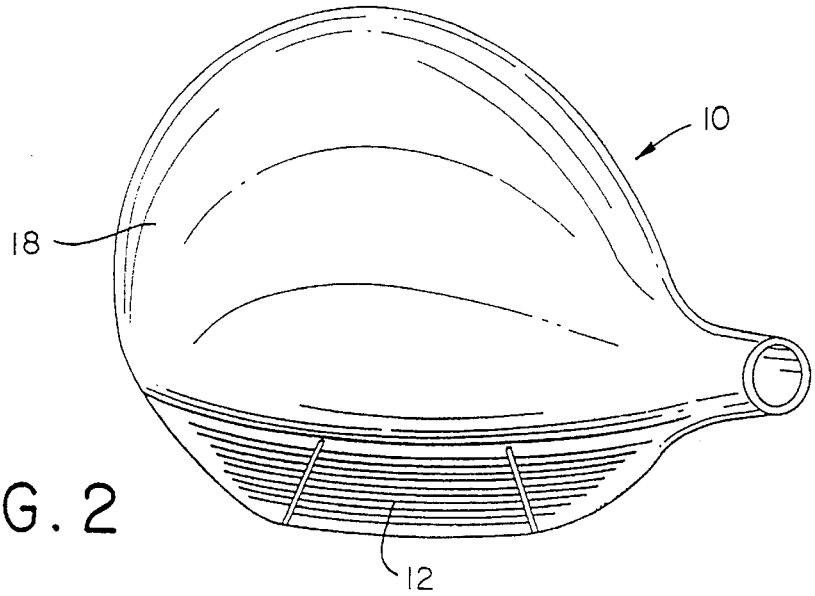
FIG. 2 is a top plan view of the club head shown in FIG. 1.
Figure 1:
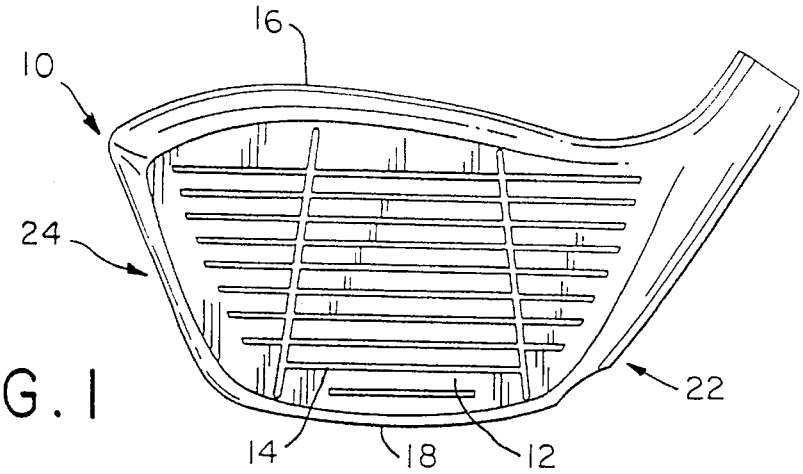
FIG. 1 is a front elevational view of a cast metal wood-type club head incorporating the improved design.
Figure 3:
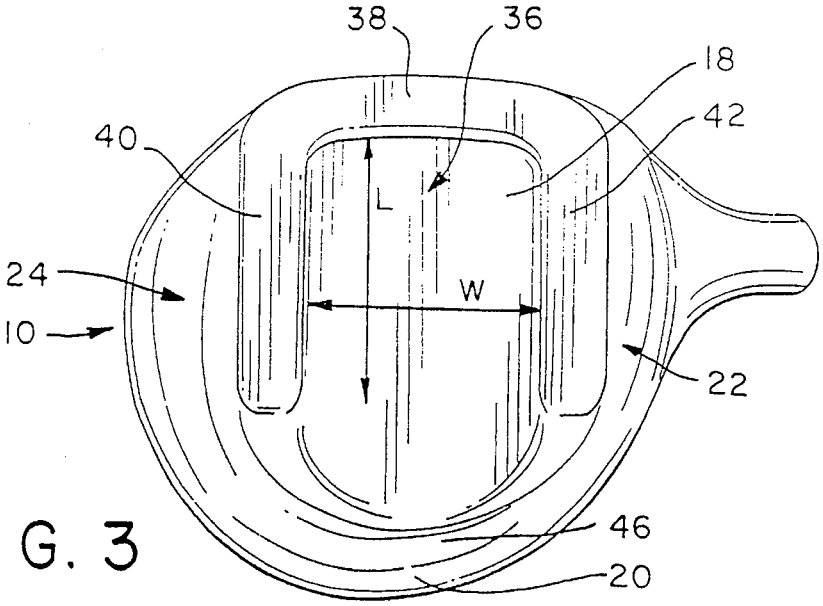
FIG. 3 is a bottom plan view thereof.
Figure 4:
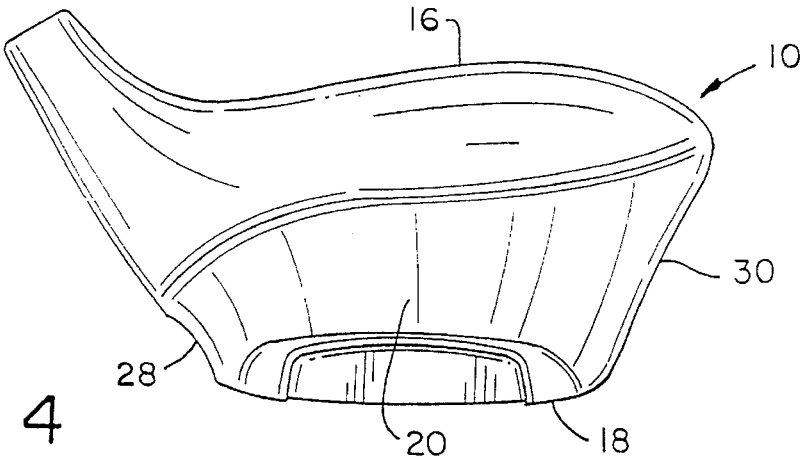
FIG. 4 is a rear elevational view thereof.
Figure 5:
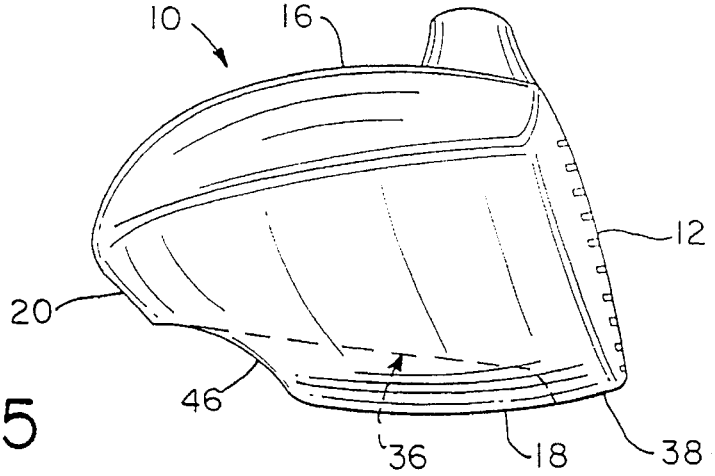
FIG. 5 is an elevational view of the left-hand end of the club of FIG. 1 looking toward the toe of the head; and, FIG. 6 is an elevational view of the right-hand end of the club head shown in FIG. 1 looking toward the heel area of the club.
Figure 6:
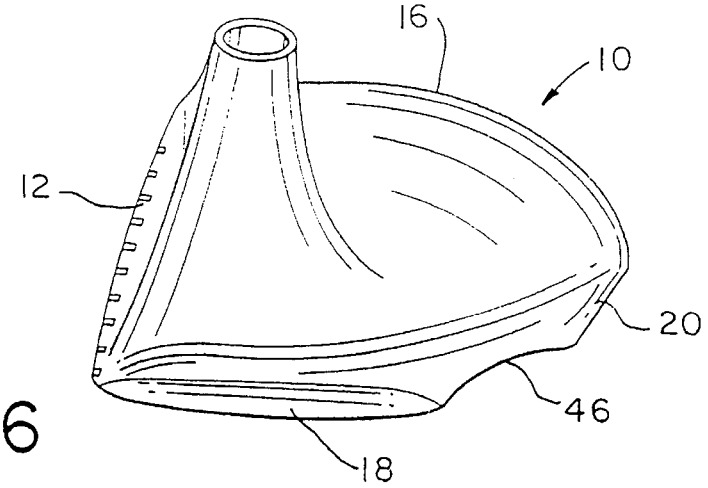
Figure 8:
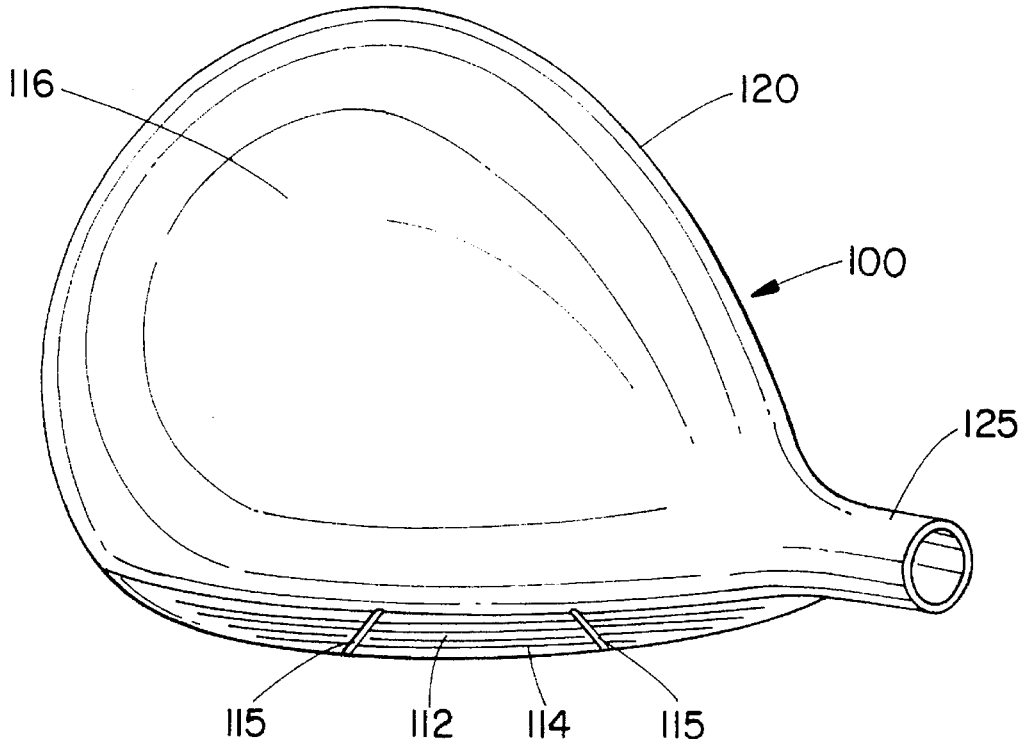
FIG. 8 is a top plan view of the club head shown in FIG. 7.
Figure 7:
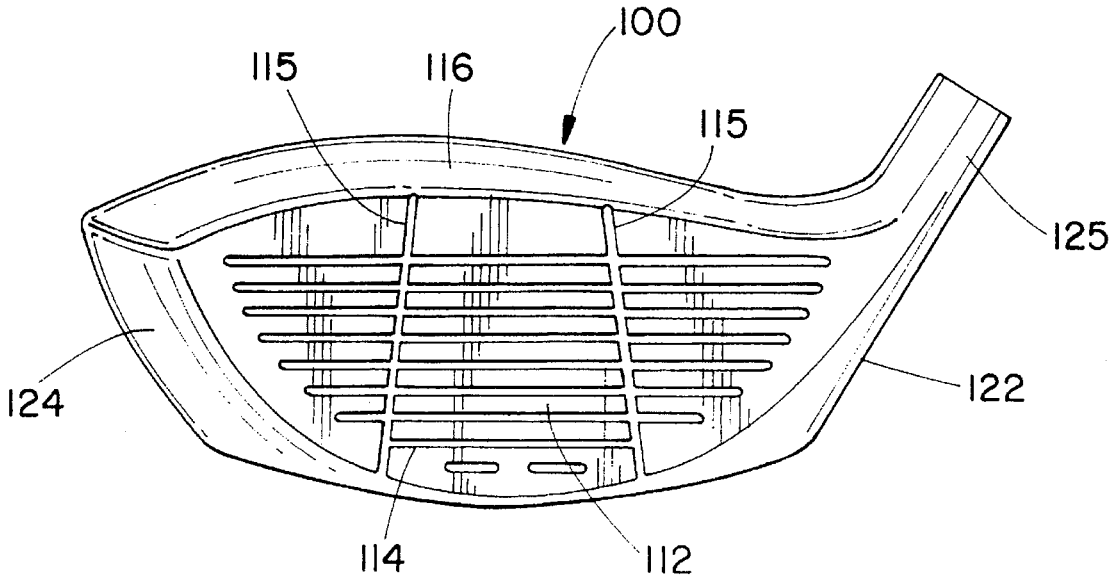
FIG. 7 is a front elevational view of a cast metal wood-type club head incorporating an alternative improved design.

Referring more particularly to FIGS. 1 through 6, the club head of the subject invention is identified generally with the reference numeral 10 and comprises a hollow metal body formed by conventional investment casting techniques from a cobalt-steel alloy identified as F-75 Cobalt. It should be appreciated, however, that many different metals or alloys could be used for forming the head of the invention and, additionally, many different known conventional forming techniques could be used. The club head as illustrated in the drawings is shown in a preferred form and the drawings illustrate the club head in actual, full size depiction. As is customary, the head includes a striking face indicated generally with the reference numeral 12 and inclined rearwardly as best seen in FIG. 5. The striking face 12 is preferably provided with suitable closely spaced grooves 14 which are cast or machined in the face in the arrangement shown. Here, again, however, many different types of grooves or surface treatments could be used to improve the engagement between the striking face and the ball.

The striking face 12 extends between an upper wall 16 and a bottom wall 18. The upper wall 16 is preferably gently contoured as illustrated and connects integrally with a rear wall 20. The rear wall 20 is curved as shown and connects with the front wall or striking face 12 through a heel area 22 and a toe area 24.

In the heel area, the hosel is formed as an integral portion of the body and extends upwardly at the predetermined angle illustrated. This angle can, of course, vary depending upon the club head lie desired and other factors necessary to suit the individual user's desires.

It should be noted that both the heel and the toe areas of the club are somewhat concave in shape as shown at 28 and 30, respectively, in FIG. 4, for example.

The sole area of the club is defined by the bottom wall 18. In this regard, the design of bottom wall be is such as to produce the previously described improved weighting and weight distribution in the club head. As illustrated, the bottom wall 18 is provided with an inwardly extending recess 36 which has a width W between the heel and toe areas and a length L extending generally in a direction perpendicular to the striking face 12. Because of the recess 36 extending inwardly of the bottom wall 18 in the manner shown, there results a ground engaging sole area comprised of a front rail portion 38 and side rail portions 40 and 42, respectively (see FIG. 3). Side rail portion 40 is adjacent the toe portion of the head and extends generally perpendicular rearwardly from the striking face 12. The rail portion 42 is also an integral continuation of the front rail portion 38 and runs adjacent the heel 22 of the head 10. Preferably, each of the rail portions 38, 40, and 42 have a width which is at least about one-half inch in width and has a height relative to the bottom of the recess in the range of from one-quarter to one-half inch.

The general configuration for the recess 36 is shown in FIG. 5 and, in the preferred embodiment, extends from a depth of approximately three hundred thousandths of an inch adjacent the front rail portion 38 to a maximum depth of approximately four hundred thousandths of an inch adjacent the rear of the side rails 40, 42. To further increase the distribution of the weight in an upward direction, the club head is provided with the concave toe and heel portions 20, 30 previously mentioned as well as the recess 46 which is shown at the lower portion of the rear wall 20 and best illustrated in FIGS. 5 and 6. This arrangement thus far described shifts the weight of the club head from the traditional spot in the center of the club to a location outwardly in the area of the outer side rail portions. In the club head illustrated, the side rail portions are spaced apart a distance of approximately one and one-quarter inches, and they have a length of approximately one and one-half inches.

As mentioned earlier, the preferred embodiment of the club head of the subject invention is formed using conventional investment casting techniques. When manufactured from the previously mentioned F-75 Cobalt alloy, the head as shown in the drawings has a weight of approximately 200 to 215 grams. In addition, the head is formed to be a hollow shell with the striking face having a thickness in the range of 0.125 to 0.136 inches and the sole plate area including the side rails being of about 0.040 to 0.050 inches in thickness. The remaining portions of the head are about 0.025 to 0.035 inches in thickness.

FIGS. 7–12 illustrate an alternative form of club head formed in accordance with the invention. The club head of this embodiment is identified generally with reference numeral 100 and comprises a hollow metal body formed by conventional investment casting techniques from a stainless steel alloy identified as 17-4. It should be appreciated, however, that many different metals or alloys could be used for forming the head of the invention and, additionally, many different known conventional forming techniques could be used. Also, it should be noted that the club head illustrated in FIGS. 7–12 is shown in approximately actual, full-size depiction.

Figure 12:
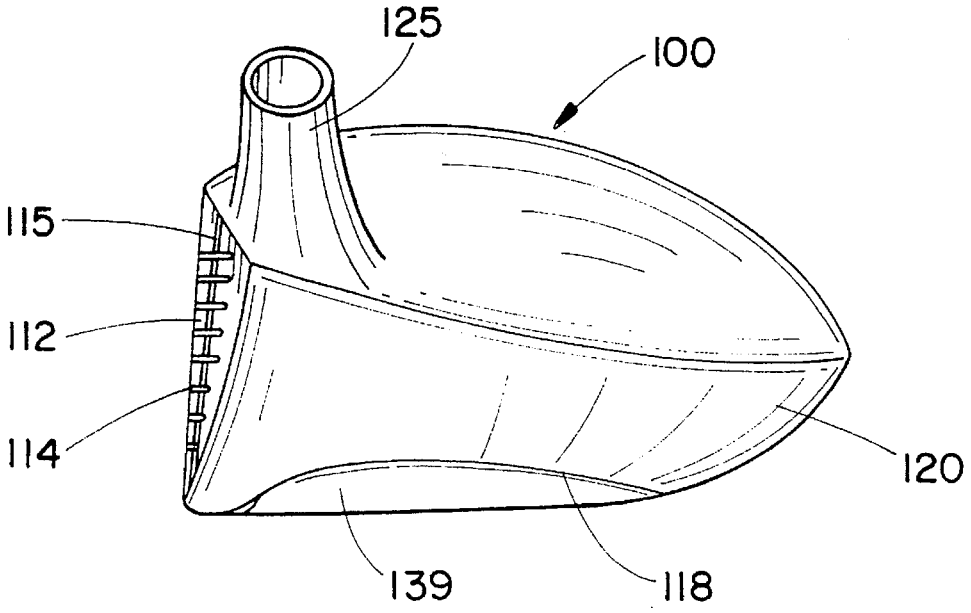

As is customary, the head 100 includes a striking face indicated generally with the reference numeral 112 which is canted rearwardly as best seen in FIG. 12. Striking face 112 is preferably provided with suitable closely spaced grooves 114 which are cast or machined into the face in an effective arrangement. Here again, however, many different types of grooves or surface treatments could be used to improve the engagement of the striking face with the ball. Vertical score lines 115 generally define a preferred impact region (center of percussion) of the striking face wherein ball impact achieves optimum distance and control.

The striking face 112 extends between an upper wall 116 and a bottom wall 118. The upper wall 116 is preferably gently contoured as illustrated and connects integrally with a rear wall 120. The rear wall 120 is curved as shown and connects with the front wall or striking face 112 via a heel area 122 and a toe area 124.

In heel area 122, a hosel 125 is formed as an integral portion of the body and extends upwardly at a predetermined angle. This angle can, of course, vary depending on the club head lie desired and other factors necessary to suit the individual user's requirements.

The sole area of the club is defined by the bottom wall 118. In this regard, the design of bottom wall 118 is such as to produce the previously described improved weighting and weight distribution of the club. Particularly, the weighted members are positioned to increase the amount of mass in the club head adjacent the optimum striking area on the club face improving the energy impact of off-center hits without significantly reducing the energy/mass available for well struck balls as is the case with traditional perimeter weighting. In addition, the invention's weighting system results in an elevation of the center of gravity.

As illustrated, the bottom wall 118 is provided with a first inwardly extending recess 136 which has a width W' defined by side rail members 140 and 142. The first recess 136 has a length L' extending generally in a direction perpendicular to the striking face 112. In addition, a second recess in the form of a toe recess 137 is defined by the side rail member 140 and front rail 138 and extends to toe area 124. A third recess shown as a heel recess 139 is defined by side rail member 142 and front rail 138 and extends to heel area 122. Because the three recesses 136, 137 and 139 extend inwardly to the bottom wall 118 in the manner shown, the club head 100 has a ground engaging sole area comprised of front rail portion 138 and side rail portions 140 and 142. Side rail portions 140 and 142 extend generally perpendicular and rearwardly from the striking face 112. Side rail portions 140 and 142 are preferably integral continuations of the front rail portion 138 creating a generally rectangular cavity 136. Preferably, each of the rail portions 138, 140 and 142 have a width which is at least about one-quarter to one-half inch in width and a height relative to the bottom of the recess in the range of from one-sixteenth to one-quarter inch. Depending upon the width of rail portions 138, 140 and 142, the length L' will be in the range of about 2⅛ to 2½ inches and the width W' will be in the range of about ⅝ to 1 1/16 inches. Particularly, a #1 wood may have a length L' of 2½" and a width W' of 1 1/16"; a #3 wood a length L' of 2 5/16" and a width W' of 1"; a #5 wood a length L' of 2⅜" and a width W' of ⅝"; and a #7 wood a length L' of 2⅛" and a width W' of ⅝". Additionally, the front rail portion extends beyond the side rails a distance of about 11/32".

In contrast to the newly developed perimeter weighting systems which disperse weight to edges of the club, while decreasing mass at the center of percussion, this arrangement shifts weight in the club head from the traditional spot in the center in the club head to a location surrounding the center of the club increasing the mass adjacent the center of percussion where most off-center hits occur. Accordingly, the club head maintains mass in the area which impacts well-struck balls, provides a larger effective impact area and greater energy is transferred to the golf ball.

Figure 10:
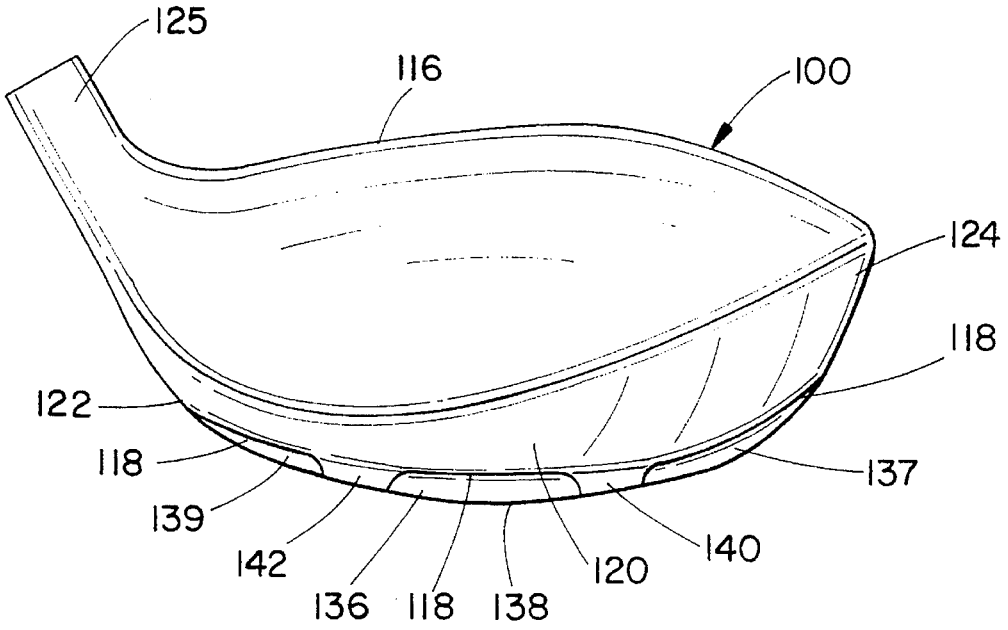
FIG. 10 is a rear elevational view shown in FIG. 7.
Figure 9:
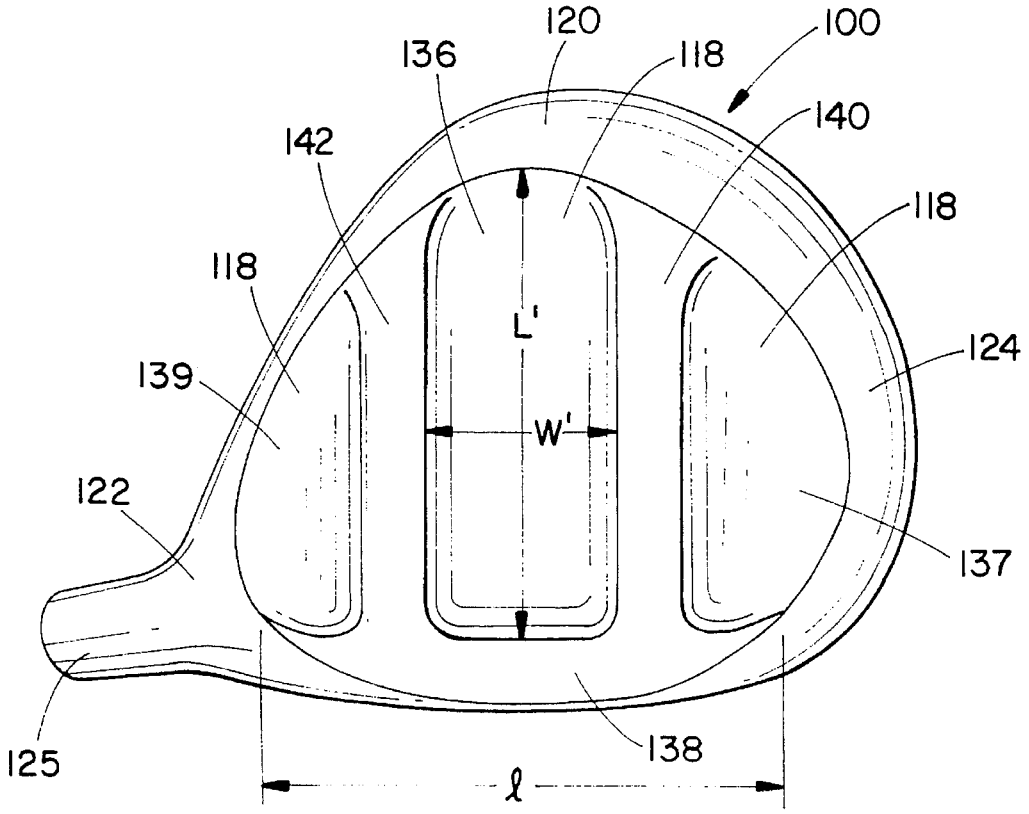
FIG. 9 is a bottom plan view of the club head shown in FIG. 7.
Figure 11:
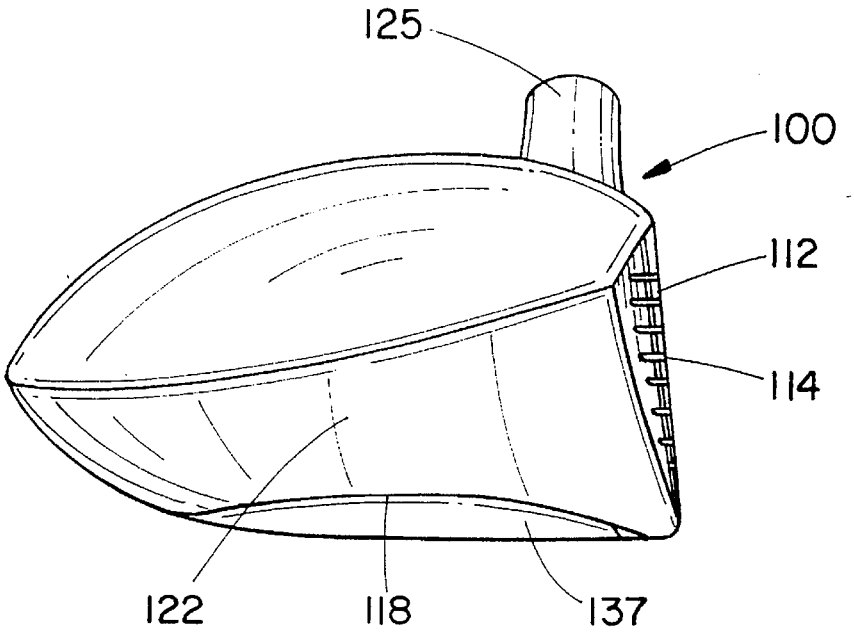
FIG. 11 is an elevational view of the left-hand end of the club head of FIG. 7 looking toward the toe area; and, FIG. 12 is an elevational view of the right-hand end of the club head shown in FIG. 7 looking toward the heel area.

As seen in FIG. 10, bottom wall 118 has a generally arcuate shape from heel area 122 to toe portion 124. The arcuate shape of bottom wall 118 in conjunction with the arcuate shape of upper wall 116 from heel to toe creates a golf club head with its thickest portion occurring at the approximate center of the club head.

When manufactured from the previously mentioned stainless steel alloy, the head as shown in the drawings L as a weight of approximately 204 to 218 grams. Preferably, a #1 wood weighs about 204 grams; a #3 wood 210 grams; and a #5 or #7 wood 218 grams.

Preferably, the head is formed to be a hollow shell with a striking face having a thickness in the range of about 2.8 to 3.2 mm.

Particularly, a #1 wood face is about 2.8 mm thick; a #3 wood face is about 3.0 mm thick; a #5 wood face is about 3.3 mm thick; and a #7 wood face is about 3.2 mm thick. Bottom wall 118 has an average thickness, excluding the side rails of about 1.4 to 1.8 inches, wherein the heel area is generally thicker. Specifically, the sole plate of a #1 wood is preferably about 1.8 mm in the heel area and 1.3 mm in the toe; a #3 wood 1.8 mm in the heel and 1.5 mm in the toe; a #5 wood 1.7 mm in the heel and 1.2 in the toe; and a #7 wood 2.0 mm in the heel and 1.6 in the toe. The remaining portions of the club head are between about 1.0 mm to 1.5 mm inches in thickness.

The invention has been described with reference to the preferred embodiments. Obviously, modifications and alterations will occur to others upon a reading and understanding of this specification. It is intended to include all such modifications and alterations insofar as they come within the scope of the appended claims or the equivalents thereof.

Having thus described the invention, it is now claimed:

1. A wood-type golf club head comprising an integral metal body having a front striking face, an upper wall, a rear wall, a heel, a toe, and a bottom wall, a first rail depending from said bottom wall adjacent the front striking face, a second rail depending from said bottom wall joined to said first rail and extending substantially perpendicular from said front rail to about said rear wall, a third rail depending from said bottom wall joined to said first rail and extending substantially perpendicular from said first rail to about said rear wall, said second rail disposed inwardly from said heel and said third rail disposed inwardly from said toe.

2. The golf club head of claim 1 wherein said rails form a generally rectangular central cavity.

3. The golf club head of claim 1 wherein the bottom wall is slightly arcuate in shape.

4. The golf club head of claim 1 wherein said bottom wall is directly connected with said heel, toe and rear walls.

5. A wood-type golf club head comprising an integral metal body having a top wall, a front striking face, a rear wall, a heel portion, a toe portion, a sole comprising a front rail adjacent said front striking face and forming a portion thereof, two substantially parallel rails integral to said front rail and perpendicular thereto extending toward the rear of said club, and a bottom wall recessed from said sole rails forming in combination with said rails, a central rectangular cavity open toward the rear of said club, a heel cavity open toward said rear and heel portion of said club, and a toe cavity open toward said rear and toe portions of said club.

6. The golf club head of claim 5 wherein the bottom wall is slightly arcuate in shape.

7. The golf club head of claim 5 wherein said bottom wall is directly connected with said heel, toe and rear walls.

8. In a golf club head comprising an integral hollow metal body having a front striking face, an upper wall, a rear wall, a heel, a toe, a bottom wall, and a hosel extending upwardly at a predetermined angle from the heel of the body for attaching a head to a shaft, the improvement wherein the bottom wall comprises three recessed cavities inwardly of the body which lie rearwardly of the front striking face such that the ground engaging sole area of the head comprises a front rail portion adjacent the front striking face and side rail portions joined to the front rail portion and extending inwardly of the heel and toe toward the rear wall, the recessed cavities having a depth sufficient to result in concentration of club head weight surrounding the center of percussion and to produce an elevation in the center of gravity of the head relative to the ground engaging sole area.

9. The golf club head of claim 8 wherein a central of said three recessed cavities has a generally rectangular shape in plan view.

10. The golf club head of claim 8 wherein a central of said three recessed cavities is generally aligned with the center of the front striking face.

11. The golf club head of claim 8 wherein the heel and the toe are recessed inwardly generally from the upper wall toward the bottom wall.

12. The golf club head of claim 8 wherein the bottom wall is slightly arcuate in shape.

13. The golf club head of claim 8 wherein of said three recessed cavities, a central cavity is deeper than a toe cavity and a heel cavity.

14. The golf club head of claim 8 wherein said bottom wall is directly connected with said heel, toe and rear walls.

15. A wood-type golf club head consisting of an integral metal body having a front striking face, an upper wall, a rear wall, a heel, a toe, and a bottom wall, a first rail depending from said bottom wall adjacent the front striking face, a second rail depending from said bottom wall joined to said first rail and extending substantially perpendicular from said front rail to about said rear wall, a third rail depending from said bottom wall joined to said first rail and extending substantially perpendicular from said first rail to about said rear wall, said second rail disposed inwardly from said heel and said third rail disposed inwardly from said toe.

16. A wood-type golf club head consisting of an integral metal body having a top wall, a front striking face, a rear wall, a heel portion, a toe portion, a sole comprising a front rail adjacent said front striking face and forming a portion thereof, two substantially parallel rails integral to said front rail and perpendicular thereto extending toward the rear of said club, and a bottom wall recessed from said sole rails forming in combination with said rails, a central rectangular cavity open toward the rear of said club, a heel cavity open toward said rear and heel portion of said club, and a toe cavity open toward said rear and toe portions of said club.

17. A non-perimeter weighted integral wood-type club head comprising:

a) a toe portion, a heel portion, a top portion, a sole portion, a front face and a rear wall;

b) said sole portion including depending ground engaging members forming a recessed generally rectangular cavity;

c) said depending portions including a front member adjacent the front face and two rearward extending members integrally formed thereto and extending perpendicular to said front member, disposed generally inwardly from said toe and heel;

d) said recessed rectangular cavity formed to produce an elevation in the center of gravity of the club head; and e) said sole portion intersecting said rear wall, forming a rectangular opening in combination with said rearward extending members.

* * * * *